United States Patent [19]

Bendler et al.

[11] 3,994,201

[45] Nov. 30, 1976

[54] SEPARATING ELEMENT

[75] Inventors: Hellmut Bendler, Nurnberg; Heinz Gawlick, Furth, Bay; Werner Siegelin, Nurnberg, Stein, all of Germany

[73] Assignee: Dynamit Nobel Aktiengesellschaft, Germany

[22] Filed: Aug. 1, 1974

[21] Appl. No.: 493,839

[30] Foreign Application Priority Data

Aug. 1, 1973 Germany ..... 2338949

[52] U.S. Cl. ..... 89/1 B; 102/1 R; 85/DIG. 1; 102/28 R

[51] Int. Cl.[2] ..... F42B 3/00

[58] Field of Search ..... 102/1, 27, 28; 89/1 B; 85/DIG. 1

[56] References Cited

UNITED STATES PATENTS

| | | | |
|---|---|---|---|
| 3,106,162 | 10/1963 | Hagerty | 102/49.4 |
| 3,277,766 | 10/1966 | Burkdoll | 85/DIG. 1 |
| 3,774,541 | 11/1973 | Bratton | 102/27 |

*Primary Examiner*—Verlin R. Pendegrass
*Attorney, Agent, or Firm*—Craig & Antonelli

[57] ABSTRACT

A separating element comprises a body member for securing at least two parts together. The body member has an electrically ignitable separating charge disposed in tamped form within a recess therein, means operatively associated with the separating charge, which when a predetermined temperature has been reached, renders the explosive effect of the separating charge ineffective and ignition means for igniting the separating charge within said recess when separation of the parts is required.

4 Claims, 3 Drawing Figures

SEPARATING ELEMENT

Figure 1:
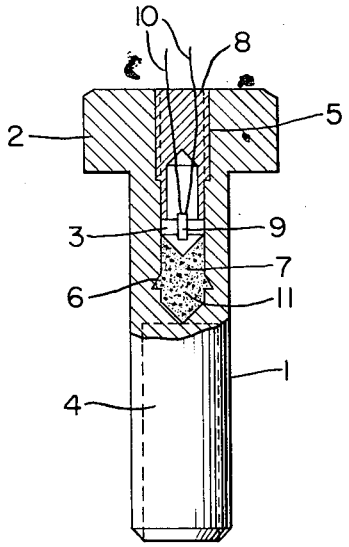

This invention relates to a separating element having an electrically ignitable separating charge disposed in tamped form within a recess.

Explosive separating elements, such as disconnecting screws and separating rivets, are known in a variety of configurations. They are utilized, for example, for the activation of safety devices such as, for example, for blasting off cockpit hoods in airplanes, for opening of emergency exits, smoke ventilating devices, etc. The separating elements, in this connection, can contain a tamped separating charge having an explosive base; after the electrical ignition of this charge, the separating elements and, more or less, also the parts held together by these elements, are destroyed and thus released and separated.

According to German Unexamined Laid-Open Application (DOS) No. 1,771,211, the separating elements can, however, also be fashioned with a definite separating resistance and with a tamped separating charge having a base of propellant powder charge, such as, for example, nitrocellulose, aminoguanidine azotetrazole in a mixture with barium nitrate, etc., in order to sever the separating element after the electric ignition at a predetermined place and to avoid a destruction of the materials at the outer parts or portions of the elements which are held together.

However, all of these separating elements can be triggered, i.e. ignited and thus cause to separate, in addition to their built-in electrical ignition for this purpose, also by means of external heating to a temperature of, for example 140° to about 400° C. In many fields of application, this effect does not have any significance. However, for example when utilizing the separating elements in the fire protection field, this thermal spontaneous ignition effect is often undesirable or in certain cases even dangerous. Thus, for example, when a fire is burning in the lower floors of multi-story building, it is possible for the high-temperature smoke gases conducted away via the smoke ventilating devices provided for this purpose to sweep past and cause the spontaneous ignition of the separating elements mounted in the smoke-ventilator flaps of the upper floors, by heating same to above 140° C., so that also the smoke-ventilator flaps of the upper floors, not yet affected by the fire, are opened up. Thereby, however, the smoke gases can penetrate into these upper floors and evoke secondary sites of combustion at these locations.

The invention is based on the problem of avoiding this disadvantage of the conventional separating elements with an electrically ignitable separating charge accommodated in tamped form in a bore, i.e. of constructing the separating elements so that thermal spontaneous ignition no longer takes place.

In order to solve this problem, it is proposed, in accordance with this invention, to associate the separating charge with a stabilizing agent or desensitizing agent which renders the separating charge ineffective when a predetermined temperature has been reached and/or to equip the separating charge with a tamp which becomes inactive when a given temperature has been attained. The stabilizing agent slows down or, under certain circumstances, entirely prevents the conversion reaction of the separating charge necessary for an explosion. The deceleration of the conversion reaction to the required extent can also be obtained by additionally or, in place thereof, the provision of rendering the tamp ineffective when a given temperature has been reached. For this purpose, it is possible to insert the tamp, produced, for example, of single- or multiple-component resins and/or adhesives of epoxy, polyester, or phenolic resins with fillers, such as powdered quartz, pulverized chalk, metallic powder, e.g. $SiO_2$, $CaCO_3$ or Fe or the like, in amounts of up to 300% by weight, and to position the electric primer, within the separating element with the use of an intermediate means which loses its strength at the predetermined temperature. This can be, for example, a metal alloy of a suitable melting point, that fills a narrow annular gap between the tamp and the corresponding inner wall of the separating element. In any event, these provisions advantageously ensure with safety that a complete inactivation and thus inoperability of the separating elements is effected at a predetermined temperature of, for example 80° C.

In a suitable embodiment of the invention, the stabilizing agent is a substance which melts when the given temperature has been reached. Preferably, such substance can be waxes of a suitable melting point, for example, the types of waxes indicated hereinbelow manufactured by Glyco Products Company, U.S.A.:

| | Melting Point and/or Range |
|---|---|
| 128 AMP Paraffin | 57 °C. |
| Wax S 932 | 57 to 61 °C. |
| Flexo Wax C | 64 to 70 °C. |
| Ceramid Wax | 79.5 to 80.5°C. |
| Albucer Wax | 99 to 104 °C. |
| Rezo Wax B | 95 to 110 °C. |

Furthermore, it is possible to employ, for example, plastic microcrystalline waxes having a melting range of 63° – 77° C., oxidized hydrocarbon waxes having a melting range of 83° – 88° C., hard microcrystalline waxes having a melting range of 87° – 94° C., or "Nibren" waxes having a melting range of 88° – 125° C. The Nibren waxes are mixtures of polychloronaphthalenes produced during the chlorination and refining of naphthalene. Additional data on suitable waxes can be found, for example, in *Ullmanns Encyklopaedie der technischen Chemie* [*Ullmann's Encyclopedia of Technical Chemistry*] third Ed., 1967, publishers Urban and Schwarzenberg, Munich-Berlin-Vienna, 18th Volume, pp. 262–305; or in *The Chemistry and Technology of Waxes* by A. H. Warth, second Ed., 1956, edited by Reinhold Publishing Corporation, New York.

In place of the waxes, however, it is also possible to employ other substances having the same or similar stabilizing effects, in correspondence with the respective purpose for which the element is used. Among these numerous other usable substances, examples are molten-together mixtures of polyethylene and vaseline, the melting point of which is dependent on the type of polyethylene and the mixture ratio; saturated and unsaturated chain-type hydrocarbons and/or the mixtures thereof having a suitable melting point; or also cyclic alcohols of a suitable melting point, such as, for example, 2-cyclodecane-1,6-diol. In general the stabilizing agent should have a melting range of from 40° to 200° C.

These solid stabilizing agents can be incorporated into the separating charge in a homogeneous distribution. The separating charge can be, for example, explosives and/or explosive mixtures containing penthrite, hexogen (i.e. cyclotrimethylenetrinitramine), or octogen (i.e. cyclotetramethylenetetramine). However, preferably, separating charges are used that are based on nitrocellulose, aminoguanidine azotetrazole in a mixture with barium nitrate or other propellant powder charges, as disclosed, for example, in DOS No. 1,646,313, in order to avoid a destruction above and beyond the defined disintegration of the separating element.

The type and amount of the stabilizing agent contained in the separating charge, its particle shape and particle size are dependent on the factors of the predetermined temperature at which, and the time interval in which, the inactivation of the separating charge is to take place, the thermal conductivity conditions from the surroundings to the separating charge, and so on. It has been found, in general that about 1 – 20% by weight — based on the weight of the separating charge — of stabilizing agent is sufficient to obtain, within a time period of about 1 – 10 minutes, the inactivation of the separating charge by the molten stabilizing agent. The largest dimension of the particles of the stabilizing agent ranges preferably between about 0.04 and 0.8 mm; with a view toward a more rapid melting, the particles are selected to be the smaller, the faster the inactivation is to take place and/or the smaller the amount of the added stabilizing agent. The upper limit for the admixture of the stabilizing agent is given by the consideration that the purposeful electric ignition and reaction of the separating charge must be ensured with certainty in a temperature range of normally −40° to +60° C. If the proportion of stabilizing agent is below the upper limit value, which is dependent on the individual case, the normal function of the separating element is not impaired, since the reaction time upon intended ignition is maximally 100 milli-seconds, but normally is even substantially shorter. This time period, however, is insufficient for melting the stabilizer particles present in the separating charge and for effecting the inactivation. An impairment of the normal separating function is thus not caused by the addition of the stabilizing agent in accordance with the present invention.

Instead of mixing the stabilizing agent or desensitizing agent into the separating charge, another proposal of this invention provides that the stabilizing agent is disposed separately beside the separating charge. This embodiment has the advantage from a manufacturing viewpoint that the prefabricated separating charges of the conventional separating elements can also be utilized in the separating element of this invention. This is done, for example, by first inserting, in the recess of the separating element provided for this purpose, the separate body produced from the stabilizing agent, and then introducing the separating charge, so that the charge is in direct contact with the body of the stabilizing agent. If in this case the predetermined temperature for preventing thermal spontaneous ignition of the charge is attained, the stabilizing agent is melted and penetrates into the porous separating charge having as its basic component, for example, penthrite, nitrocellulose, or aminoguanidine azotetrazole in a mixture with barium nitrate, etc., so that the intended inactivation of the separating element is executed. In this connection, it is unnecessary for the stabilizing agent to penetrate so far into the separating charge that any reaction at all is avoided; rather, the only decisive factor is that the conversion reaction which may after all take place is reduced in its effect to such an extent that it no longer accomplishes the separation of the separating element. The spatial arrangement of the stabilizing agent relative to the separating charge is generally such that the heat transfer from the surroundings to the stabilizing agent is maximally favorable and the molten stabilizing agent can readily penetrate into the separating charge.

According to the invention, it is furthermore possible to arrange a partition with one or more bores between the stabilizing agent and the separating charge. This is advantageous in an individual case when it is necessary to compensate for the reduction of the tamping of the separating charge, caused by the greater elasticity of the stabilizing agent. By means of the partition, one can avoid the possible need for an increase in the mass of the separating charge. The number of bores and the inside cross section thereof in the partition made of steel, brass, aluminum, or the like, is here again dependent on the circumstances of the individual case, such as the inactivation temperature and time, flow behavior of the stabilizing agent, structure of the separating charge, etc.

Instead of subdividing the loading space of the separating element into two chambers by means of a more or less perforated partition, another provision of the invention provides the further possibility of arranging a partition between the stabilizer and the separating charge, which partition is made of a material melting when the predetermined temperature has been reached, preferably a metal alloy. For this purpose, the partition can be produced, for example, of Wood's metal, composed of 25% by weight of lead, 12.5% by weight of cadmium, 50% by weight of bismuth, and 12.5% by weight of tin and melting at between 60° and 70° C. Additional data on suitable materials melting at a given temperature can be derived, for example, from *Huette, Des Ingenieurs Taschenbuch, Theoretische Grundlage* [*Iron Works, The Engineer's Manual, Basic Theory*] 28th Edition, 1955, publishers Wilhelm Ernst & Sohn, Berlin, in the section entitled "Stoffkunde"[-"Information on Materials"]; or in *Chemical Engineers' Handbook* third Edition, 1950, McGraw-Hill, New York. In additon to metal alloys of a suitable melting point, all other metals and non-metals can also be used which melt, disintegrate or decompose, or the like within the given period of time at the predetermined temperatre, so that the subdivision of the two chambers is eliminated. The material of the partition does not affect the activity of the separating charge or of the desensitizing agent.

With the use of a partition of a material melting upon reaching of the predetermined temperaure, it is also possible according to this invention to employ a liquid stabilizing agent which is tightly enclosed in the chamber of a loading space intended for this purpose until the predetermined temperature has been attained, thus being separated from the separating change. Preferably, such liquid stabilizing agent is an aqueous sodium acetate or ammonium acetate solution containing about 5–30% by weight of sodium or ammonium acetate, respectively. However, it is also possible, for example, to use dibutylphthalate or dioctylphthalate. In this connection, it is possible according to a further provision of this invention to dispose the liquid stabilizing agent also within a sealed capsule of a material melting at the predetermined temperature, preferably a metal alloy, insofar as this should prove advantageous in an individual instance.

Depending on the requirements, the provision can be made additionally to the stabilizing agent or also in place thereof, to render the tamp of reached. separting charge ineffective when the given temperature has been reduced. For this purpose, a further provision of the invention is to provide the separating element with a bore sealed off with a material melting at the predetermined temperature, preferably a metal alloy; this bore, after the material has melted, establishes a connection between the separating charge and the surroundings, overcoming the tamping of the separating charge. Suitable sealing materials are practically the same as mentioned above for the partition to be melted. This advantageously affords the possibility to overcome the tamping, when a temperature of 90° C. has been reached, for example, to such an extent that the conversion reaction which may take place upon further heating in the separating charge no longer entails a disintegration of the separating element. For this purpose, it is not absolutely necessary to vacate the bore completely, but rather only a partial melting off of the sealing material of the bore may be sufficient under certain circumstances.

In order to prevent, with the purposeful electric triggering of the separating element, even under unfavorable conditions, the possibility that the material sealing the bore is expelled under the pressure of the thus-produced gases, thereby causing an undesirable exhausting of the gases, it is possible according to this invention to provide a form-fitting connection between the walls of the bore and the sealing material, by widening the bore at the end on the separating charge side in its cross-section so that the sealing material can rest, under the pressure of the gases, on the shoulder formed thereby. However, instead, it is also possible, for example, to provide the bore along a more or less large portion of its length with an internal thread flush and fittingly engaged by the sealing material.

Figure 2:
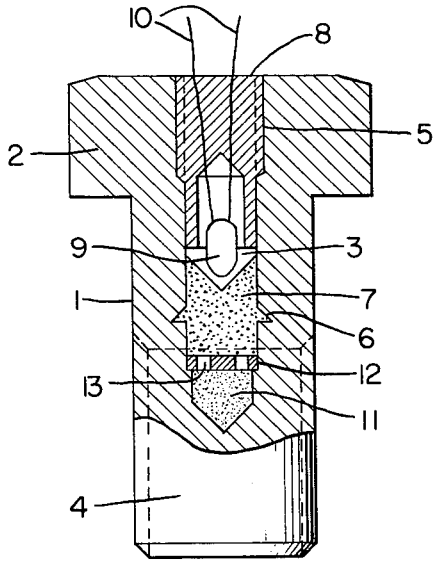
Figure 3:
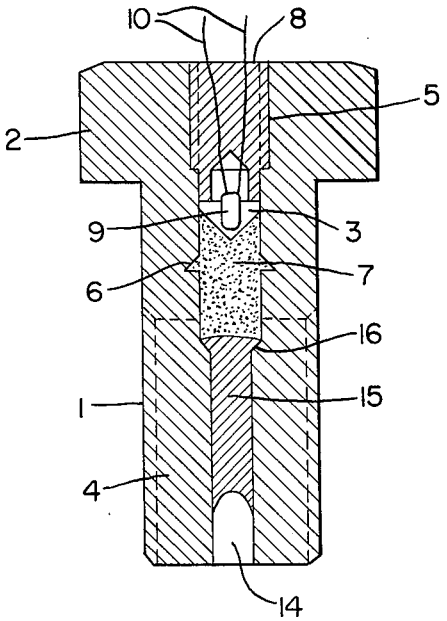

Various embodiments of the invention are shown in the accompanying drawings and will be explained in greater detail below with reference thereto wherein:

FIG. 1 shows a separating element in the form of a screw in a partial longitudinal section; and FIGS. 2 and 3 show two different modifications thereof.

FIG. 1 shows a separating element in the form of a separating screw 1 made of steel, for example, having a body portion with an axial recess 3 starting at the head 2 of the screw 1. This recess extends approximately to the center of the shank 4 provided with an external thread. The recess 3 has a thread 5 in the head portion and an annular notch 6 effective as a predetermined breaking zone in the lower shank portion. The separating charge 7 with the stabilizing agent 11 admixed therein is provided in the recess 3 in the region of the predetermined breaking zone, for example, in the form of a pressed body made up of an explosive mixture of 95wt.% of nitrocellulose and 5wt. % of wax, i.e. wax S932. If the screw material has great strength, the separating force of the explosive mixture can be increased by adding priming substances, such as tetrazene or nitroguanidine in amounts of 5–30% by weight. The separating charge 7 is tamped by the plug 8 of resins such as polymethacrylate and araldite (epoxy resin) threadedly inserted therein, the primer pellet 9, made of primary explosive and ignitable electrically, being attached to this plug.

In order to obtain a maximally defined energy transmission and thus a flawless functioning of the separating element in case of purposeful ignition, a good seal must be provided for the plug 8 in the thread 5, as well as for the passage accommodating the ignition lines or wires 10 for the primer pellet 9. This seal can be ensured by the use of single or multiple-component resins and/or adhesives, for example those containing epoxy, polyester, or phenolic resins as a coating around the threaded portion of the plug 8 and also around the lines 10. A further improvement of the sealing effect can be obtained by admixing, to the case resin and/or adhesive, fillers such as ground quartz, chalk powder, metallic powder, or the like in amounts of up to 300% by weight to obtain not only an adhesive action between the plug and the thread 5, but also a maximally form-fitting plug 8 maintaining its flush junction with the thread 5 also in case of high pressure stresses that is practically unchanged and to ensure the desired tamping.

In the separating screws shown in FIGS. 2 and 3, identical parts bear the same reference numerals used therefor in FIG. 1. As contrasted to FIG. 1, the separating charge 7 and the stabilizing agent 11 are arranged separately from each other in the embodiment of FIG. 2 by means of the partition 12 made, for example, of steel. The partition 12 has the bores 13, for example four in number, which can, however, also be omitted if the partition is produced instead from steel of a material melting when the given temperature has been reached. The partition 12 rests on a shoulder formed in the recess 3 and is inserted in the recess 3 with a press fit especially in case of a stabilizing agent 11 that is a liquid, so that the tight seal with respect to the separating charge 7 is ensured.

The separating screw 1 according to FIG. 2 functions as follows: The stabilizing agent 11, which is in the solid phase, becomes soft and/or is liquefied at a specific temperature, e.g. 80° – 90° C., and penetrates via the bores 13 of the partition 12 into the separating charge 7. The explosive effect of the separating charge 7, preferably consisting of nitrocellulose, is reduced by the stabilizing agent 11 to such an extent that the screw 1 is no longer separated. The purpose of the partition 12 in this arrangement is an improved tamping of the separating charge 7 in the functional range of −40° to +60° C. With the use of a pellet or the like of wax, for example, which would be arranged below the separating charge 7 without the partition 12, an increase in the weight of the separating charge 7 is generally required in order to compensate for the higher elasticity of the wax as compared with the steel.

In FIG. 3, a separating screw 1 is illustrated which, in contrast to the screw shown in FIG. 2, does not have a partition 12 but rather is provided with an axial bore 14, sealed with a readily melting material 15, e.g. Wood's metal. The bore 14 is widened in its cross-section at 16 on the end facing the separating charge, so that the material 15 can rest against the shoulder formed thereby when exposed to the pressure by the gases of the separating charge 7. When a certain temperature has been exceeded, the material 15 in the bore 14 is softened and flows out of the bore to a greater or lesser extent. If, due to outside heat influences, the separating charge 7 is ignited at this point in time, the tamping required for a flawless separation is eliminated and the effect of the separating charge 7 is lost through the bore 14 which now is vacant or tamped only slightly.

The present invention is not limited to separating screws of the type described hereinabove, but rather covers all types of separating elements, such as, for example, rivets, rope severing devices, or the like.

It will be understood from the foregoing description that the separating element of this invention becomes entirely inoperable by heating to the predetermined temperature, for example 120° C. Thereafter, it can no longer be ignited electrically.

When used in smoke venting devices, the separating elements are triggered electrically before they have been heated to such an extent that they become inoperable. The electric ignition of the separating elements is intiated, for example, by way of smoke signaling devices arranged at a more or less distant location.

Also, it will be appreciated that a liquid desensitizing agent is preferably employed in an amount of 5 – 30% by weight, based on the separating charge substance and that the inactivating temperature of the separating element can range preferably between 40° and 200° C., depending on the individual case.

Moreover, in order to be able to determine the fact that the thermal inactivation of the separating elements has taken place, the separating elements can be painted, on a visible surface, for example the screw head, with "Thermocolor" paints of the firm A. W. Faber Castell, Stein/Nuernberg [W. Germany]. These paints are altered as soon as they have been heated to a given temperature. Thus, it is merely necessary to apply the Thermocolor paint governing for the respective inactivating temperature, in order to be able to determine from the color change whether the separating element has been heated to or above the inactivating temperature.

The following two examples are set forth for the separating charge and the desensitizer:

| | | |
|---|---|---|
| (1) | Barium nitrate | 45.5% by weight |
| | Diaminoguanidine azotetrazole | 45.5% by weight |
| | "Flexo Wax C", a product of Glyco Chemicals, Inc., which is a synthetic, non-crystalline hydrocarbon wax | 9 % by weight |
| (2) | 90% by weight of a mixture consisting of: | |
| | Ammonium nitrate | 79% by weight |
| | Active carbon | 12% by weight |
| | Ammonium oxalate | 8% by weight |
| | Vanadium pentoxide | 1% by weight |
| | 10% by weight of a 30% strength sodium acetate solution. | |

Furthermore, the separating charges can generally be used with porosity spontaneously resulting during the manufacture according to conventional production methods, for example the pressing of the powders. If this porosity is insufficient in an individual instance to make it possible for the desensitizer to penetrate into the separating charge quickly enough, fillers can be added to the separating charge which are removed after the shaping of this charge. Thus, it is possible, for example, to add to a separating charge on the basis of nitrocellulose, potassium nitrate in an amount of 100–300% by weight, which latter compound is washed out again after the molding of the separating charge element, by means of water.

It will also be appreciated that the space above the primer pellet 9 is normally empty. However, if the separating element of this invention is used under very great external mechanical stresses, the exclusive mounting of the primer pellet 9 by means of the ignition lines 10, as shown in the figures, sometimes is no longer sufficient. In such a case, a special supporting means, for example in the manner of a spider, can be provided in the empty space above the primer pellet 9, supporting the latter with respect to the plug 8 and/or the head 2.

While the novel embodiments of the invention have been described, it will be understood that various omissions, modifications and changes in these embodiments may be made by one skilled in the art without departing from the spirit and scope of the invention.

What is claimed is:

1. A separating element which comprises a body having a preselected shape for securing at least two parts together, said body having a separating explosive charge disposed in tamped form within a recess therein, tamp means within said recess operatively associated with said separating charge which, when a predetermined temperature has been reached, becomes ineffective, and electrical ignition means for igniting said separating charge within said recess when separation of said parts is required at a functional temperature below said predetermined temperature.

2. The separating element according to claim 1, wherein the separating element has a bore sealed with a material melting when the predetermined temperature has been reached, which bore, after the melting of the material establishes a communication between the separating charge and the atmosphere thereby eliminating the tamping of the separating charge.

3. The separating element according to claim 2, wherein said material is a metal alloy.

4. The separating element according to claim 2, wherein the bore is widened in its cross-section at an end adjacent to the separating charge.

* * * * *